United States Patent [19]

Ubukata

[11] 4,368,449

[45] Jan. 11, 1983

[54] CONTACT MECHANISM FOR TEMPERATURE SWITCH USING THERMAL EXPANSION MEMBER

[76] Inventor: Kazumi Ubukata, Daiichi-Miyazukiso 103, 395-2 Ushinuma, Tokorozawashi, Saitamaken, Japan

[21] Appl. No.: 241,212

[22] Filed: Mar. 6, 1981

[30] Foreign Application Priority Data

Oct. 25, 1980 [JP] Japan ..... 55/149742

[51] Int. Cl.[3] ..... H01H 37/46

[52] U.S. Cl. ..... 337/313; 200/67 B; 200/242; 337/318; 337/396

[58] Field of Search ..... 337/313, 314, 318, 320, 337/390, 393, 394, 396, 397; 200/242, 61.04, 67 B, 67 PK

[56] References Cited

U.S. PATENT DOCUMENTS 2,728,826 12/1955 Lauder ..... 200/67 B
3,327,946 6/1967 Benson ..... 200/67 B
3,996,435 12/1976 King ..... 200/67 B
4,262,274 4/1981 Howe et al. ..... 337/396

FOREIGN PATENT DOCUMENTS 2444931 4/1976 Fed. Rep. of Germany ..... 337/396
2376507 9/1978 France ..... 200/242

*Primary Examiner*—William H. Beha, Jr.
*Attorney, Agent, or Firm*—Armstrong, Nikaido, Marmelstein & Kubovcik

[57] ABSTRACT

A contact mechanism for a temperature switch using a thermally expandable member wherein a plate making a circular arc motion is provided at a tip of a piston which is moved by the thermal expansion member, and a coil spring is mounted between a middle of a movable member having a fulcrum in an almost center of the plate and a stationary end of a terminal. The movable member is reversibly mounted. The plate is moved by the motion of the piston. When a point of power of the movable member is shifted, the movable contact is shifted instantly to the stationary contact side, and the movable contact slides on the stationary contact by the motion of the piston. The coil spring doubles as the return spring.

1 Claim, 9 Drawing Figures

CONTACT MECHANISM FOR TEMPERATURE SWITCH USING THERMAL EXPANSION MEMBER

FIELD OF THE INVENTION

This invention relates to a contact mechanism of a cooling fan switch of an engine of an automobile or of a temperature switch for temperature control of equipment of similar machines.

BACKGROUND OF THE INVENTION

The adhesion of foreign materials on the contact surface of a switch causes many troubles in conventional switches. Namely, inferior conductivity resulting from the generation of an insulation material on the contacts on account of arcing degrades the operation of the switch.

Under these circumstances, the feature of the construction of this invention is such that one contact is caused to slide after the operation of the switch, and the contact performs the cleaning action of the contact surfaces.

SUMMARY OF THE INVENTION

This invention relates to a contact mechanism for a temperature switch using a thermally expandable member wherein a plate making a circular arc motion is provided at a tip of a piston which is moved by the thermal expansion member, and a coil spring is mounted between a middle of a movable member having a fulcrum in an almost center of the plate and a stationary end of a terminal. The movable member is reversibly mounted. The plate is moved by the motion of the piston, and when a point of power of the movable member is shifted, the movable contact is shifted instantly to the stationary contact side. The movable contact slides on the stationary contact by the motion of the piston, and when a point of power of the movable member is shifted, the movable contact is shifted instantly to the stationary contact side. The movable contact slides on the stationary contact by the motion of the piston, and the coil spring doubles as the return spring.

DETAILED DESCRIPTION OF EMBODIMENT

Figure 1:
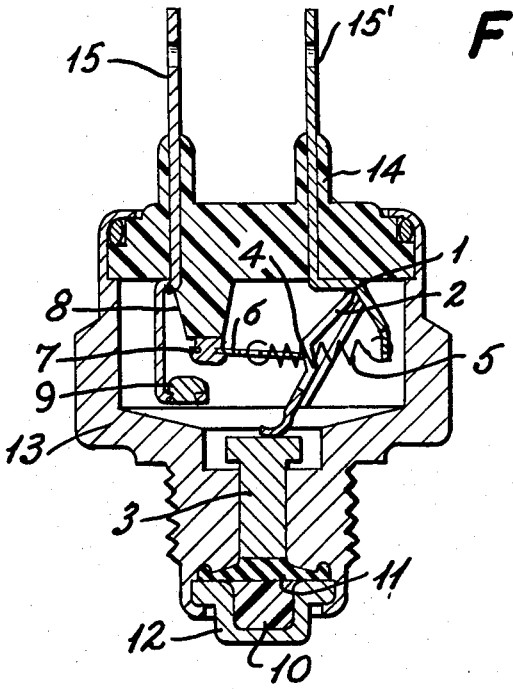
FIG. 1 is a cross section of the contact mechanism of the invention and shows the OFF condition.

Symbols in FIG. 1 are described in the following. Reference numeral 1 denotes a stationary fulcrum point of a terminal piece 15' and a plate 2. A movable fulcrum point 4 is provided at almost the center of the plate 2. A coil spring 5 is mounted between a mid portion of a movable member 6 and a stationary end of the terminal member 15'. However, the coil spring 5 provides a resilient force to reverse the movement of the movable member 6.

A thermally expandable member 10 made of wax or the like is connected to a piston 3 by means of a diaphragm 11 housed in a case 12. Member 10 can be made of any suitable thermally expanding or contracting material. An upper end of the piston 3 supports a lower end portion of the plate 2. Reference numeral 13 denotes a switch case, and numeral 14 denotes a terminal base supporting terminal members 15, 15' respectively.

Figure 2:
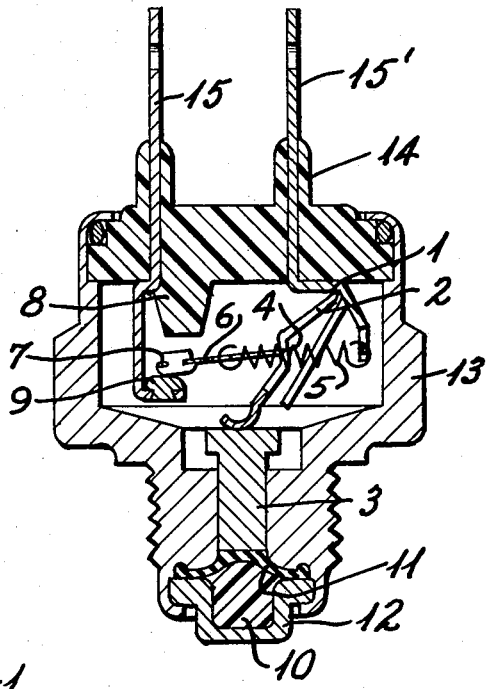
FIG. 2 shows the ON condition similarly.
Figure 3:
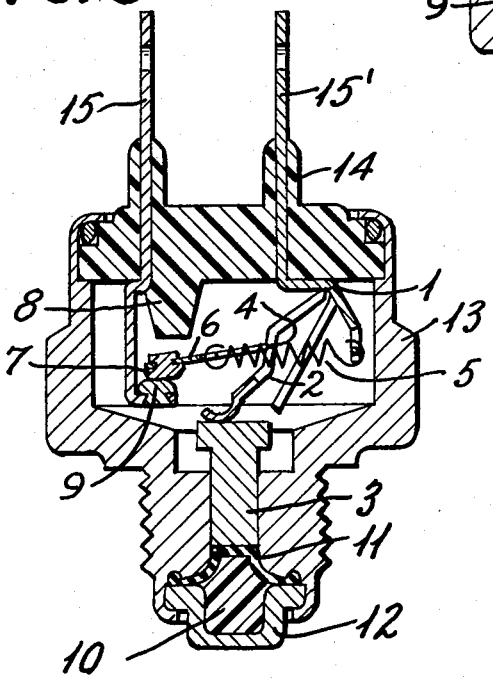
FIG. 3 is a cross section of the condition wherein the movable contact slides on the stationary contact.
Figure 4:
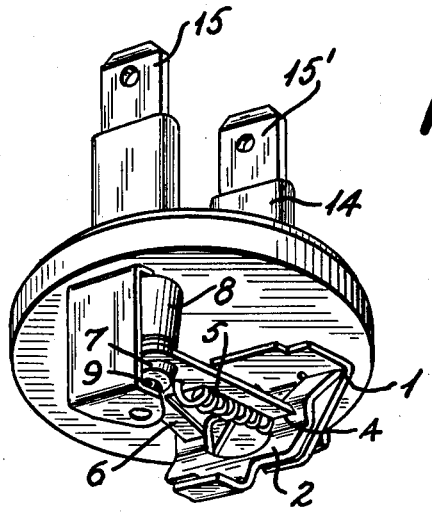
FIG. 4 is a perspective view of the essential portion of the contact.
Figure 5:
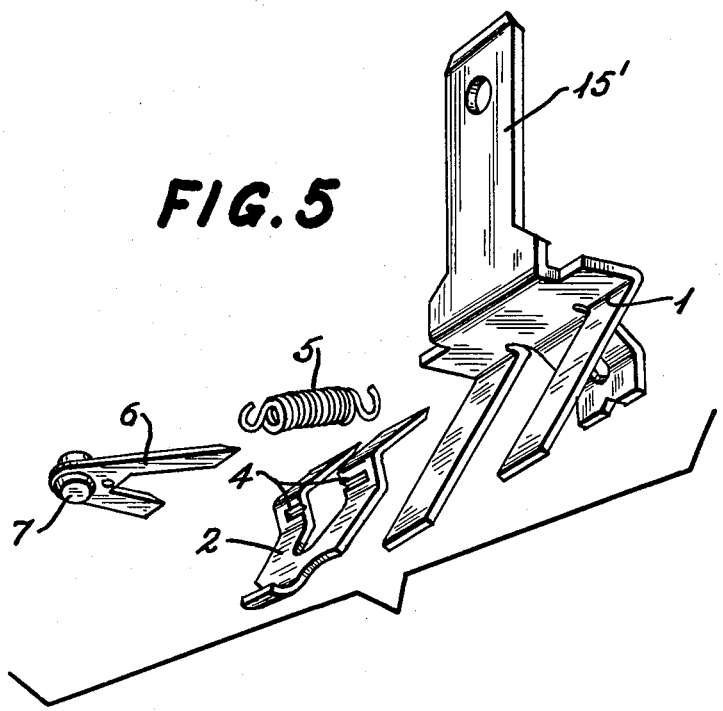
FIG. 5 is an exploded perspective view of the essential portions of the FIG. 4.
Figure 6A:
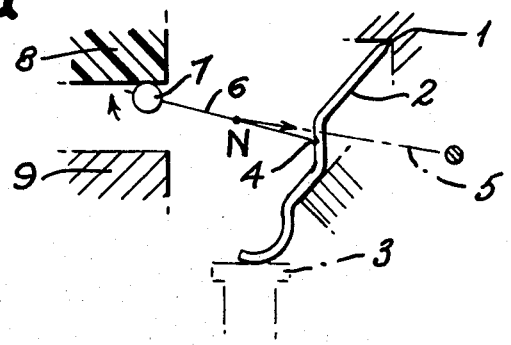
FIGS. 6*a*–6*d* are a continuous explanatory view showing the order of operations of the essential portions of this invention.
Figure 6B:
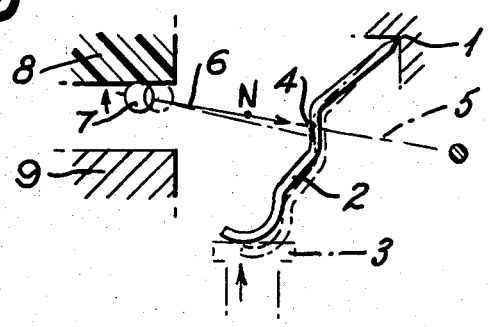
Figure 6C:
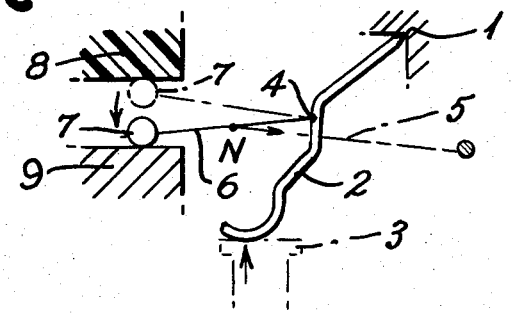
Figure 6D:
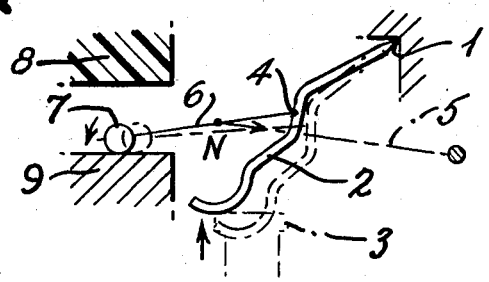

A stationary contact 9 is provided on the lower end of the terminal member 15, and is opposed to the movable contact 7. Also, this movable contact 7 is controlled at its upper limit of movement by a stationary base 8 working as a stopper. Stationary base 8 is shown made of an insulator material in FIGS. 1–3 but could also be a second stationary contact as shown in FIGS. 6*a*–6*d*. The stationary contact 9 can also be an integral part of the switch case 13 provided that the piston 3 is made of an insulator material.

Accordingly, the stationary contact 9 is electrically connected to the terminal 15 directly and the movable contact 7 is electrically connected to the plate 2 by means of the movable member 6. Plate 2 is in electrical contact with the terminal member 15'.

The contact mechanism of the switch of this invention will be described with reference to FIGS. 6*a*–*d*.

When the piston 3 is not moved at room temperature, a clockwise turning movement is applied on the plate 2 centering around the movable fulcrum point 4 by the force of the coil spring 5 applied to the N point of the movable member 6, and the movable contact 7 is urged against the stationary base 8.

FIG. 6 (*a*): When the heat is applied, the piston 3 lifts, and the plate 2 performs the circular arc motion in a clockwise direction centering around its stationary fulcrum point 1 as the base point. The movable fulcrum point 4 on the plate 1 is displaced.

FIG. 6 (*b*): The force of the coil spring 5 in the contracting direction and the reacting force of the movable member 6 are balanced. The force of urging the movable contact 7 against the stationary base 8 becomes zero, and moreover, when the slight displacement is applied to the plate 2, the movable fulcrum point 4 exceeds the dead point momentarily, and the moment of reversal direction counter clockwise (turn) is generated. At this moment, the movable contact 7 is shifted instantly to the stationary contact 9 side from the stationary base 8 side.

FIG. 6 (*c*): Thereafter, when the piston is further lifted, the plate 2 performs the circular arc motion so as to push the movable member 6 out to the stationary contact 9 side, and as the result, the movable contact 7 is slid on the stationary contact 9.

FIG. 6 (*d*): The force opposing the lifting force of the piston 3 acts on the force of the coil spring 5 in its contracting direction which is mounted at the center of the movable member 6 on the plate 2 and one end of the terminal. As the result, the coil spring 5 works not only as the snap action of the switch but also works as the return spring.

Moreover, when the temperature drops and the lifting force of the piston 3 is decreased after the reversal of the movable member 6, the movable contact 7 is shifted to the position where the force of the coil spring 5 in its contracting direction and the reacting force of the movable member 6 are balanced while the movable contact 7 again slides on the stationary contact 9. When the temperature drops further, the movable fulcrum point 4 exceeds the dead point and the movable contact 7 is shifted to the stationary base 8 side instantly, and the switch is turned to OFF. FIGS. 6 (*a*), (*b*) show the OFF condition, and FIGS. 6 (*c*), (*d*) show the ON condition. Depending on the positioning of the stationary contact, the switch can be a normally-OFF switch or a normally-ON switch.

As described in the foregoing, since the movable contact 7 operates according to the elevation and descending of temperature, and performs a sliding motion on each operation, the contact surface of both the contacts is always kept clean. Thus, foreign material and insulation material or the like are eliminated from the contact surface, which results in the absence of troubles causing inferior conductivity. These effects are excellent features of this invention.

While the invention has been particularly shown and described with reference to a preferred embodiment thereof, it will be understood by those skilled in the art that various changes in form and details may be made therein without departing from the spirit and scope of the invention.

What is claimed is:

1. A thermally operated temperature switch comprising;

a switch case;

at least one terminal member mounted in the case and insulated therefrom, the terminal member having a first fulcrum point thereon and a stationary end displaced away from the first fulcrum point;

a plate having opposite ends, a center, and a second fulcrum point slightly displaced from the center, one of the ends of the plate being positioned in the first fulcrum point and pivotable therein;

a thermally expandable member mounted in the case, a piston movably mounted in the case and operably associated with the thermally expandable member, the other end of the plate resting on the piston and being movable thereby;

a stationary contact in the case;

a movable member having opposite ends and a middle, one of the ends being positioned in the second fulcrum point and pivotable therein;

a movable contact on the other end of the movable member; and a coil spring biased between the middle of the movable member and the stationary end of the at least one terminal member;

whereby when the thermally expandable member changes size, thereby moving the piston, the plate pivots in the first fulcrum point moving the second fulcrum point whereby the movable member is instantly shifted by the biasing of the coil spring as second fulcrum point passes a dead point thereby making or breaking contact between the movable contact and the stationary contact, further movement of the piston further moving the plate and causing the movable contact to slide on its place of resting.

* * * * *